US006309223B1

(12) United States Patent
Wolfe

(10) Patent No.: US 6,309,223 B1
(45) Date of Patent: Oct. 30, 2001

(54) TERMINAL ASSEMBLY FOR FLEXIBLE CIRCUIT STRIP

(75) Inventor: George B. Wolfe, Plymouth, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/593,048

(22) Filed: Jun. 13, 2000

(51) Int. Cl.[7] ..... H01R 12/00
(52) U.S. Cl. ..... 439/67
(58) Field of Search ..... 439/492, 329, 439/67, 77, 603, 589, 374, 375, 377, 76.1, 498, 379, 499, 493, 399–405; 361/413, 417, 398

(56) References Cited

U.S. PATENT DOCUMENTS

| | | | | |
|---|---|---|---|---|
| 4,068,915 | * | 1/1978 | Evans | 439/401 |
| 4,519,659 | | 5/1985 | Shiino et al. . | |
| 4,735,582 | | 4/1988 | Fusselman et al. . | |
| 4,987,516 | | 1/1991 | Belanger, Jr. et al. . | |
| 5,160,269 | | 11/1992 | Fox, Jr. et al. . | |
| 5,192,833 | | 3/1993 | Gibson . | |
| 5,306,162 | | 4/1994 | Armendariz . | |
| 5,529,502 | | 6/1996 | Peltier et al. . | |
| 5,865,642 | | 2/1999 | Rugg . | |
| 6,083,032 | * | 12/2000 | Daoud | 439/374 |
| 6,165,009 | * | 12/2000 | Anbo et al. | 439/498 |

* cited by examiner

*Primary Examiner*—Brian Sircus
*Assistant Examiner*—J. F. Duverne
(74) *Attorney, Agent, or Firm*—Tarolli, Sundheim, Covell, Tummino & Szabo L.L.P.

(57) ABSTRACT

A terminal assembly (10) for terminating a flexible circuit strip (12) that has a flexible conductor (e.g., 14A) extending along the strip. The assembly includes a terminus portion (24) of the strip (12) that has a registration opening (e.g., 40A). A rigid electrical contact (e.g., 28A) has a portion (34) that is pierced into the flexible conductor (e.g., 14A) and a portion (30) that extends away from the terminus portion (24) of the strip (12). A carrier (42) has a registration projection (e.g., 46A) that extends through the registration opening (e.g., 40A) and a retainer portion (e.g., 50A) engaged with the portion (30) of the contact (e.g., 28A) that extends away from the terminus portion (24) of the strip (12) to hold the contact at an orientation relative to the terminus portion of the strip.

9 Claims, 1 Drawing Sheet

TERMINAL ASSEMBLY FOR FLEXIBLE CIRCUIT STRIP

FIELD OF THE INVENTION

The present invention relates to a terminal assembly for a flexible circuit strip, and specifically relates to improvements in mechanical integrity for the terminal assembly.

BACKGROUND OF THE INVENTION

Flexible circuit strips are well known in the art as a means of providing multiple, parallel-extending electrical conductors. Each conductor has a small cross-sectional area, and a flexible strip of substrate material supports the plurality of conductors. Typically, each conductor of a flexible circuit strip is an electrically conductive carbon ink trace printed upon the substrate.

Often, in order to connect a flexible circuit strip to its proper connection location, contact pins are crimped to a terminal end of the flexible circuit strip. Each terminal contact pin is to be electrically connected to one of the conductors of the flexible circuit strip. The terminal contact pins are typically terminated into wire leads or soldered into a rigid circuit board.

For flexible circuit strips, as with all electrical devices, mechanical integrity is an issue that must be considered such that proper electrical operation is accomplished and maintained. Specifically, with regard to flexible circuit strips, a loss of mechanical integrity may cause intermittent or total loss of electrical connection. When a finished product that contains a terminated flexible circuit strip is moved, disruption such as vibration may occur that may impose upon the mechanical integrity of the flexible circuit strip and the associated connection.

SUMMARY OF THE INVENTION

In accordance with one aspect, the present invention provides a terminal assembly for a flexible circuit strip that has a flexible conductor extending along the strip. A terminus portion of the strip has a registration opening. The rigid electrical contact has a portion pierced into the flexible conductor and a portion extending away from the terminus portion of the strip. A carrier has a registration projection extending through the registration opening. The carrier also has a guide portion that is engaged with the portion of the contact that extends away from the terminus portion of the strip to hold the contact at an orientation relative to the terminus portion of the strip.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF THE PREFERRED EMBODIMENT

Figure 1:
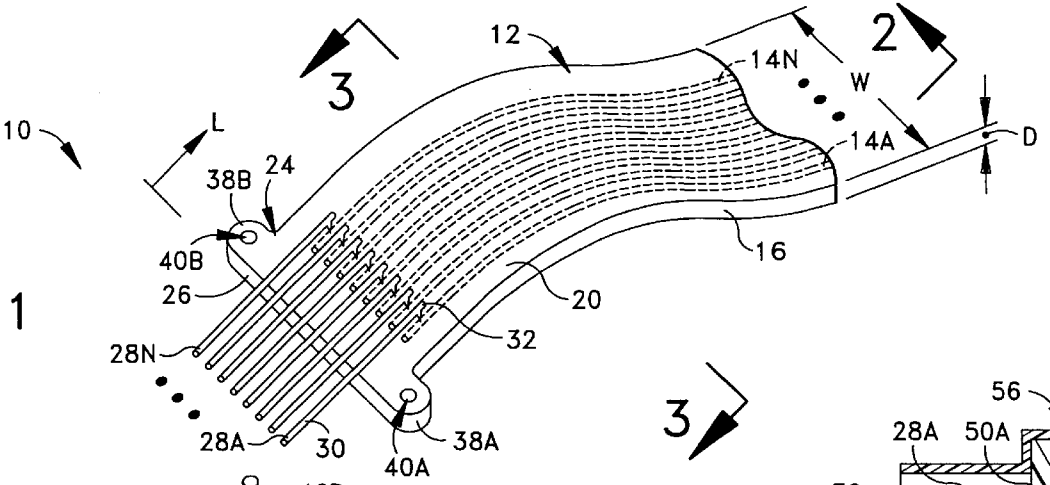
FIG. 1 is an exploded perspective illustration of a terminal assembly in accordance with the present invention.

A terminal assembly 10 in accordance with the present invention is shown in FIG. 1. The terminal assembly 10 is for an elongate, flexible circuit strip 12 that has at least one flexible conductor (e.g., 14A) extending along the strip and a substrate 16 that carries/supports the conductor. Preferably, the flexible circuit strip 12 has a plurality of conductors 14A–14N that extend parallel to each other along the strip. Such a flexible circuit strip is commonly referred to as a flex circuit. Hereinafter, the flexible circuit strip 12 is referred to as the flex circuit 12.

Preferably, the flexible conductors 14A–14N that extend along the flex circuit 12 are comprised of conductive and flexible carbon ink. Also, preferably, the substrate 16 that supports the conductors has a plurality of laminate layers (not shown in detail). Ink traces that comprise the conductors 14A–14N are printed upon a first laminate layer. Another laminate layer extends on top of the ink traces to insulate, protect, and isolate the traces from each other and from outside environmental influence.

The flex circuit 12 has any desirable length L. Application use of the flex circuit 12 is one factor that contributes to a determination regarding desired length. A width W of the flex circuit 12, as measured at any point along a majority of the length L of the flex circuit, is somewhat related to the number of conductors 14A–14N that are present within the flex circuit. Typically, the flex circuit 12 has a generally flat appearance in that the width W of the flex circuit is generally much larger than depth D of the flex circuit that is measures perpendicular to the length L and width W of the flex circuit. Accordingly, the preeminent surfaces that are present on the flex circuit are the upper and lower surfaces 20 and 22, as viewed in the Figures.

The conductors (i.e., the ink traces) 14A–14N extend to a terminus portion of the flex circuit 12. In the illustrated example, the conductors 14A–14N do not extent to an end edge 26 of the flex circuit, but instead extend to within a short distance to the end edge.

The terminal assembly 10 includes a plurality of terminal contacts 28A–28N. The number of terminal contacts 28A–28N is typically equal to the number of conductors (i.e., ink traces) 14A–14N within the flex circuit 12. Each terminal contact (e.g., 28A) is made of an electrically conductive material such as copper or gold.

Figure 2:
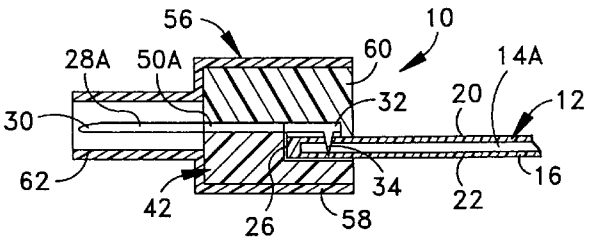
FIG. 2 is a view taken along line 2—2 of FIG. 1, with the assembly in a completed condition.
Figure 3:
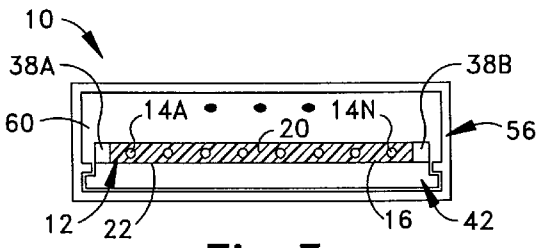
FIG. 3 is a view taken along line 3—3 of FIG. 1, with the assembly in a completed condition.

In the illustrated example, the terminal contacts 28A–28N the terminal contacts are identical and are in the general shape of pins. Each terminal contact (e.g., 28A) is elongate with first and second end portions 30 and 32. Preferably, each terminal contact (e.g., 28A) has a circular cross-sectional area, for a cross-section taken perpendicular to the elongate extent of the terminal contact, for most of the elongate extent. The first end portion 30 is preferably tapered. The second end portion 32 contains at least one sharp protrusion 34 (FIG. 2) that extends generally perpendicular to the elongate extent of the terminal contact (e.g., 28A).

Each terminal contact (e.g., 28A, FIG. 1) is located at the terminus portion 24 of the flex circuit 12 such that the first end portion 30 extends away from the terminus portion of the flex circuit. The second end portion 32 of each terminal contact (e.g., 28A) engages the terminus portion 24 of the flex circuit 12 with the sharp protrusion 34 (FIG. 2) being pierced into the flex circuit and pierced into an associated one of the conductors (e.g., the ink trace 14A). Thus, electrical connection exists between each terminal contact (e.g., 28N) and the associated conductor (e.g., 14N) of the flex circuit 12.

At the terminus portion 24 of the flex circuit 12, the substrate 16 is enlarged, widthwise, to provide at least one registration portion (e.g., 38A). Specifically, in the illustrated example, the width of the flex circuit 12 at the terminus portion 24 is greater than the width W along the majority of the extent of the flex circuit. In the illustrated example, the flex circuit 12 has two registration portions 38A and 38B, one on each side (i.e., left and right) of the flex circuit. Each registration portion (e.g., 38A) has an opening (e.g., 40A) that extends completely through the substrate 16 of the flex circuit 12 from the upper surface 20 to the lower surface 22. Preferably, each registration opening (e.g., 40A) is circular in cross-section.

A carrier 42 of the terminal assembly 10 includes a base 44 and at least one registration projection (e.g., 46A) that extends from the base. Preferably, the number of registration projections 46A and 46B corresponds to the number of registration openings 40A and 40B within the flex circuit 12, and registration openings have cross-sectional shapes that are complementary to the registration openings (e.g., circular). A spacing distance between the registration projections 46A and 46B is equal to a spacing distance between the registration openings 40A and 40B. Further, the registration projections 46A and 46B preferably extend parallel to each other and orthogonal to the base 44.

The registration projections 46A and 46B are located on the base 44 of the carrier 42 such that with the registration projections 46A and 46B extending through the registration openings 40A and 40B, the terminus portion 24 of the flex circuit 12 lays at least partially on the base 44 of the carrier 42. Also, with the registration projections 46A and 46B extending through the registration openings 40A and 40B, the conductors 14A–14N of the flex circuit 12 and the associated terminal contacts 28A–28N are located adjacent to the base 44 and are located between the two registration projections.

The carrier 42 includes a plurality of retainer projections 50A–50M that extend from the base 44. The retainer projections 50A–50M are interspersed adjacent to and between the terminal contacts 28A–28N when the flex circuit 12 and the associated terminal contacts are located adjacent to the base 44 of the carrier 42. The retainer projections 50A–50M provide a function of holding the terminal contacts 28A–28N in an orientation relative to the carrier 42, and thus in an orientation relative to the terminus portion 24 of the flex circuit 12.

In the illustrated example, the retainer projections 50A–50M are elongate ridges. Each ridge has its elongate extend in a direction that is parallel to the extent of the terminal contacts 28A–28N. Thus, the elongate retainer projections 50A–50M provide a plurality of elongate grooves 52A–52N. The spacing between each adjacent pair of retainer projections (e.g., 50A and 50B), and thus the width of each groove (e.g., 52A) is such that the sides of the retainer projections grip the associated terminal contact (e.g., 28A) to hold the terminal contact in place.

A housing 56 of the terminal assembly 10 encloses the carrier 42, the terminus portion 24 of the flex circuit 12, and the terminal contacts 28A–28N. Accordingly, the housing 56 aids in retaining together the flex circuit 12, the carrier 42, and the terminal contacts 28A–28N. The housing 56 may have any suitable shape for enclosing the other portions (24, 42, and 28A–28N) of the terminal assembly 10 and for interacting with the member or unit (not shown) to which the terminal assembly is to be connected.

In the illustrated example, the housing 56 has a first hollow portion 58 within which the carrier 42, the terminus portion 24 of the flex circuit 12, and the second portions 32 of the terminal contacts 28A–28N are located. A potting material 60 is provided in areas within the first portion 58 of the housing 56 that are not otherwise occupied. The first end portions 30 of the terminal contacts 28A–28N extend into a space bounded by a hollow second portion 62 of the housing 56. An exterior of the second portion 62 of the housing 56 may be configured or keyed in any suitable manner to aid/ensure proper mating of the terminal assembly 10 to the member or unit to which the terminal assembly is to be connection. Upon connection of the terminal assembly to the member or unit, it is to be appreciated that each terminal contact makes electrical connection to a respective portion of the member or unit.

From the above description of the invention, those skilled in the art will perceive improvements, changes and modifications. Such improvements, changes and modifications within the skill of the art are intended to be covered by the appended claims.

Having described the invention, the following is claimed:

1. A terminal assembly for a flexible circuit strip having a flexible conductor extending along the strip, said assembly comprising:

a terminus portion of the strip having a registration opening;

a rigid electrical contact having a portion pierced into the flexible conductor and a portion extending away from said terminus portion of the strip; and a carrier having a registration projection extending through said registration opening and a retainer portion engaged with the portion of said contact that extends away from said terminus portion of the strip to hold said contact at an orientation relative to said terminus portion of the strip.

2. An assembly as set forth in claim 1, including a housing encircling said terminus portion of the strip, said contact, and said carrier.

3. An assembly as set forth in claim 2, including a potting material located with said housing and engaging parts of said terminus portion of the strip, said contact, and said carrier.

4. An assembly as set forth in claim 1, wherein said registration opening is a first registration opening and said registration projection is a first registration projection, said terminus portion has a second registration opening and said carrier has a second registration projection that extends through said second registration opening, and said contact is located between said first and second registration projections.

5. An assembly as set forth in claim 1, wherein the conductor is a first conductor and said contact is a first contact, the flexible circuit has a plurality of flexible conductors and said assembly has a plurality of rigid metal contacts, and each of said contacts has a portion pierced into a respective one of the flexible conductors and a portion that extends away from said terminus portion of the strip.

6. An assembly as set forth in claim 5, wherein said retainer portion is a first retainer portion, and said carrier has a plurality of retainer portions engaged with said plurality of contacts to hold said contacts relative to said terminus portion of the strip.

7. An assembly as set forth in claim 5, wherein each of said plurality of retainer portions is elongate, and said plurality of retainer portions provide a plurality of grooves through which said plurality of contacts extend.

8. An assembly as set forth in claim 5, wherein said plurality of rigid metal contacts and said carrier combine with said housing to provide a terminal assembly.

9. An assembly as set forth in claim 8, wherein said terminal assembly is part of a pushpin connector arrangement, with said plurality of rigid metal contacts being the pushpin connectors configured to interact with a receiver member of the pushpin connector arrangement.

* * * * *